US007536895B2

(12) United States Patent
James

(10) Patent No.: US 7,536,895 B2
(45) Date of Patent: May 26, 2009

(54) DEFORMED FORGING

(75) Inventor: Malcolm R James, Christchurch (NZ)

(73) Assignee: Rolls-Royce plc, London (GB)

( * ) Notice: Subject to any disclaimer, the term of this patent is extended or adjusted under 35 U.S.C. 154(b) by 389 days.

(21) Appl. No.: 11/327,410

(22) Filed: Jan. 9, 2006

(65) Prior Publication Data

US 2006/0107718 A1 May 25, 2006

Related U.S. Application Data

(63) Continuation of application No. PCT/GB2004/002989, filed on Jul. 9, 2004.

(30) Foreign Application Priority Data

Jul. 30, 2003 (GB) ..... 0317765.6

(51) Int. Cl.
*B21D 22/00* (2006.01)

(52) U.S. Cl. ..... 72/356; 72/105; 72/377; 72/370.23

(58) Field of Classification Search ..... 72/31.03, 72/31.06, 55, 340, 341, 356, 367.1, 370.04, 72/370.06, 370.13, 370.23, 370.24, 105, 72/377; 29/412, 414, 415, 416
See application file for complete search history.

(56) References Cited

U.S. PATENT DOCUMENTS

| | | | | |
|---|---|---|---|---|
| 988,834 A | | 4/1911 | Stiefel | |
| 1,719,720 A | | 7/1929 | Olsen | |
| 3,069,756 A | * | 12/1962 | Colestock | 29/893.36 |
| 3,344,634 A | * | 10/1967 | Ellenburg | 72/31.06 |
| 4,073,180 A | * | 2/1978 | Pahnke et al. | 72/453.01 |
| 4,208,777 A | | 6/1980 | Walsh | |
| 4,541,157 A | * | 9/1985 | Tsushima et al. | 29/898.066 |
| 4,688,407 A | * | 8/1987 | Schroder | 72/111 |
| 5,101,653 A | | 4/1992 | Hermes | |
| 5,218,762 A | * | 6/1993 | Netto Da Costa | 29/888.02 |
| 5,261,159 A | * | 11/1993 | Yasuda et al. | 29/898.066 |
| 5,577,323 A | * | 11/1996 | Sawai et al. | 29/898.066 |
| 6,506,018 B1 | | 1/2003 | Brennan | |
| 6,883,358 B2 | * | 4/2005 | Hauf | 72/85 |

FOREIGN PATENT DOCUMENTS

| | | |
|---|---|---|
| CH | 0 135 555 A | 9/1929 |
| DE | 3 316 134 A | 11/1983 |
| GB | 0 393 636 SP | 6/1933 |
| GB | 0 789 155 SP | 1/1958 |
| GB | 1 405 223 SP | 9/1975 |
| GB | 1 526 626 SP | 9/1978 |
| GB | 1 557 872 SP | 12/1979 |
| JP | 62227540 AB | 10/1987 |
| JP | 2003117632 AB | 4/2003 |

* cited by examiner

*Primary Examiner*—Edward Tolan
(74) *Attorney, Agent, or Firm*—W. Warren Taltavull; Manelli Denison & Selter PLLC

(57) ABSTRACT

A method of manufacturing a forging for forming a split casing comprising the steps of creating a forging, for example, by a ring rolling process and then deforming the forging by compressing it along a first axis and/or extending it along a second axis.

6 Claims, 4 Drawing Sheets

DEFORMED FORGING

This is a continuation of International Application Number PCT/GB2004/002989 filed Jul. 9, 2004, designating the United States.

FIELD OF THE INVENTION

The present invention relates to a method of manufacturing a forging for forming a split casing. It particularly relates to forgings which are used to form the casing for a gas turbine engine.

BACKGROUND OF THE INVENTION

The current process for forming a gas turbine engine casing is illustrated in FIGS. 1A, 1B, 1C and 1D. FIG. 1A illustrates a forging 10 created using a ring rolling process. The forging 10 has a cylindrical shape, where the axis of the cylinder extends into the page. The cross-section of the forging 10 illustrated in FIG. 1A is annular. The inner surface 12 of the forging 10 and the outer surface 14 of the forging 10 are concentric cylinders.

The forging 10 is used to form an axial split casing 20 for a gas turbine engine. It may be formed from corrosive resistant steel, titanium or nickel alloy.

FIG. 1B illustrates a rough machining which is carried out on the forging 10 of FIG. 1A before the casing 10 is split to form the casing 20. If an orthogonal coordinate system (X, Y) is defined with the origin on the axis of the cylindrical forging 10, then the forging is rough machined in the following way:

a. A lathe is used to remove material from the interior of the forging 10. The lathe cuts a cylindrical tube of radius R1 centred at (−X1, 0).

b. A lathe is used to remove material from the interior of the forging 10. The lathe cuts a cylindrical tube of radius R1 centred at (X1, 0).

c. A lathe is used to remove material from the exterior of the forging 10. The lathe cuts a cylindrical tube of radius R2 centred at (0, Y2).

d. A lathe is used to remove material from the exterior of the forging 10. The lathe cuts a cylindrical tube of radius R2 centred at (0,−Y2).

In FIG. 1B, the circular dashed lines indicate the original boundaries of the forging 10 before rough machining. The solid lines indicate the boundaries of the forging after rough machining. The dotted lines indicate lines at Y=−X1 and Y=+X1.

The forging is then axially split by removing the material between −X1 and +X1 as shown in FIG. 1C to form first 20*a* and second 20*b* portions of the axial split casing 20. Fine machining of the portions 20*a*, 20*b* is then carried out for example, by milling the interior and exterior of the portions.

The two portions 20*a*, 20*b* are then joined as shown in FIG. 1D, to form the axial split casing 20. It will be appreciated, that the axial split casing has a substantially cylindrical shape.

The rough machining of the interior and exterior of the forging illustrated in FIG. 1B is required to compensate for the removal of material between −X1 and +X1 when the forging is split axially so that the finished product, the axial split casing 20 is substantially cylindrical.

There are several problems associated with the above mentioned process. A considerable amount of material may need to be removed from the interior and the exterior of the forging during the rough machining process. This is a waste of material and also results in excessive wear to the lathes used to perform the rough machining.

It would therefore be desirable to provide an improved process for forming an axial split casing.

SUMMARY OF THE INVENTION

According to a first aspect of the present invention there is provided a method of manufacturing a forging for forming a split casing comprising the steps of: creating a forging; and deforming the forging to compress it along a first axis and/or extend it along a second axis perpendicular to the first axis.

BRIEF DESCRIPTION OF THE DRAWINGS

For a better understanding of the present invention reference will now be made by way of example only to the following Figs. in which.

DETAILED DESCRIPTION OF THE INVENTION

Figure 2A:
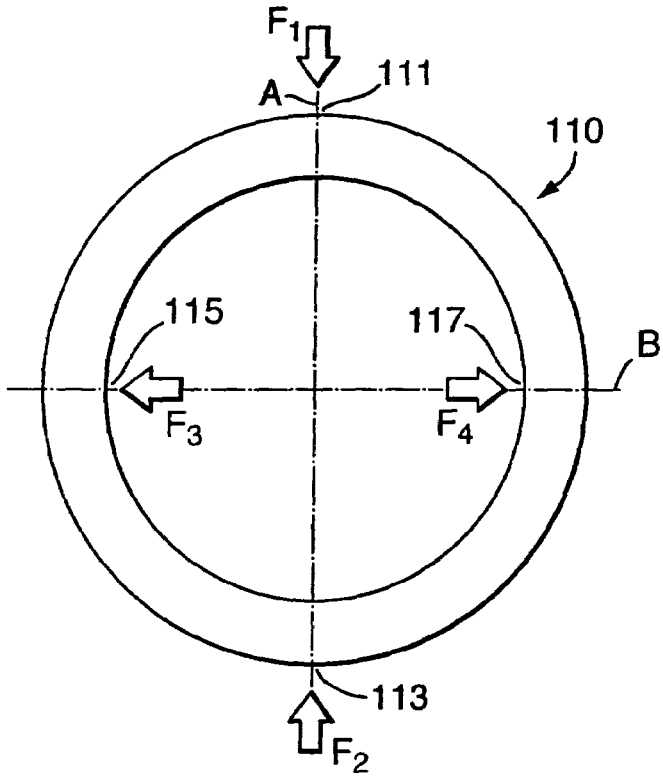

The forging 110 illustrated in FIG. 2A is formed by a ring rolling process and it may, for example, be made from corrosion resistant steel, titanium or a nickel alloy. The forging 110 has a cylindrical tubular shape, where the axis of the cylindrical tube extends into the page. The cross-section of the cylindrical tubular forging 110 illustrated in FIG. 2A is annular. The inner surface 112 of the forging 110 and the outer surface 114 of the forging 110 are concentric cylinders.

Figure 2B:
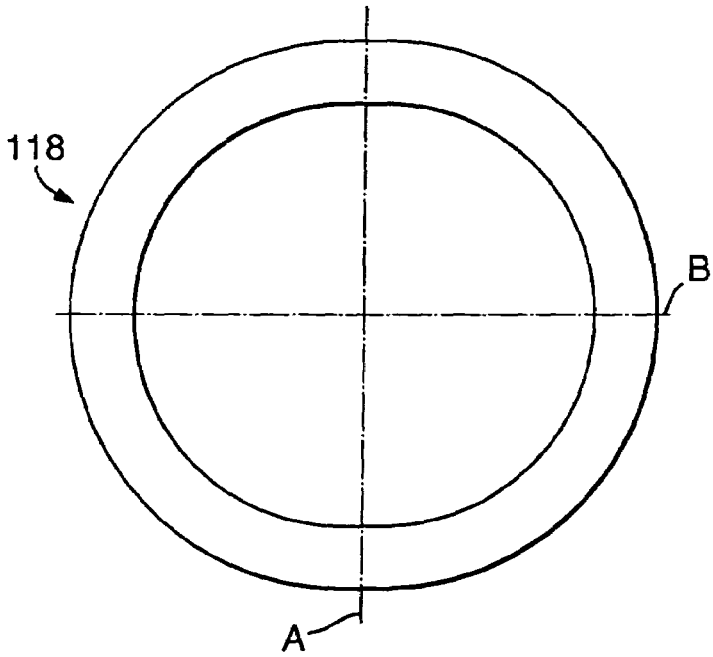
Figure 2C:
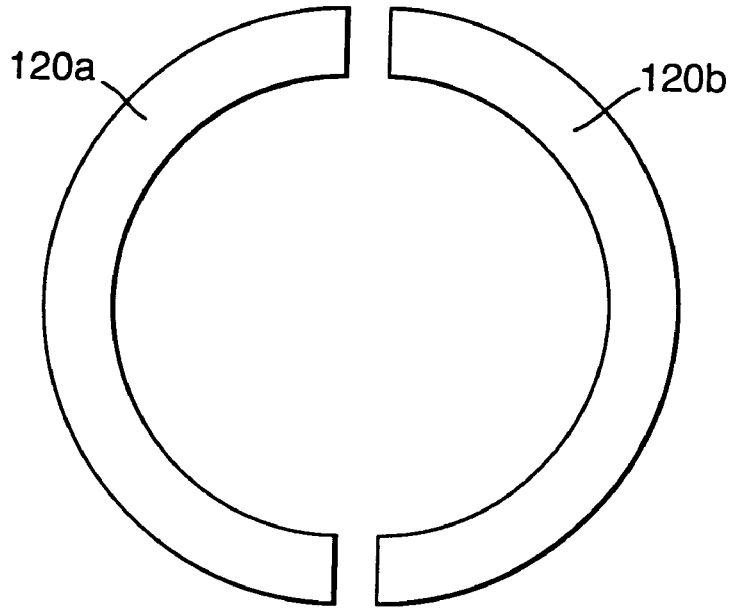

The forging 110 of FIG. 2A is deformed to form the deformed forging 118 illustrated in FIG. 2B. The deformation may be achieved by compressing the forging along the axis A, which passes through the axis of the cylindrical forging 110, dividing it into two equal portions. Alternatively, or in addition, the cylindrical forging may be deformed by extending the cylindrical forging of FIG. 2A along the axis B which extends through the axis of the cylindrical forging and divides the cylindrical forging into two equal portions. The first axis A and the second axis B are orthogonal to each other and to the axis of the cylindrical forging 110. The deformation is achieved by using mandrels to apply force to the forging 110. For example, to compress the forging along the axis A, a first mandrel is used to apply a force F1 along the first axis towards the axis of the cylindrical forging 110 at position 111 and a second mandrel is used to apply an opposing force F2 at position 113 along the axis A towards the axis of the cylindrical forging 110. In order to extend the forging along the second axis B, a third mandrel applies a force F3 to the interior surface of the cylindrical forging at a position 115 along the axis B away from the axis of the cylindrical forging 110 and a fourth mandrel applies a force F4 to the interior surface of the cylindrical forging at a position 117 along the axis B away from the axis of the cylindrical forging 110.

Figure 2D:
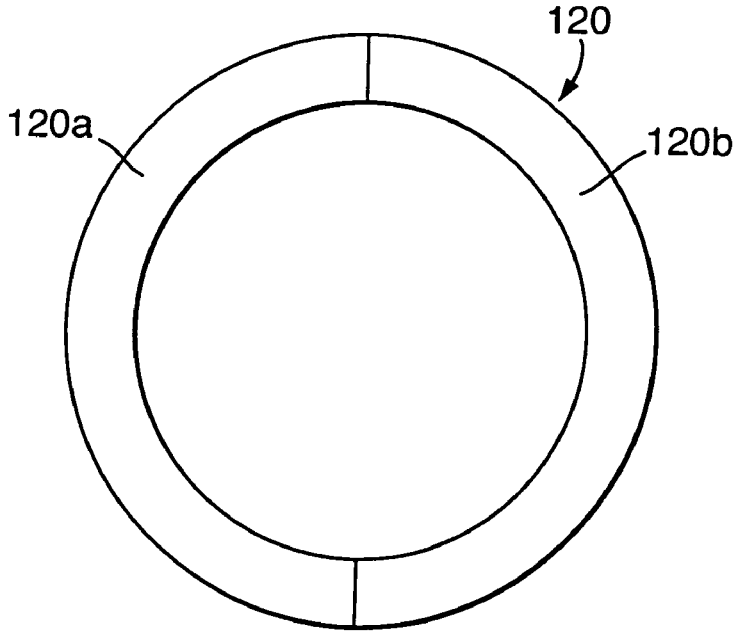

The deformed forging 110 is then split along the first axis A. The splitting of the deformed cylindrical forging produces first 120*a* and second 120*b* portions of an axial split casing 120. When joined the portions 120*a*, 120*b* create a substantially cylindrical tubular casing 120 as shown in FIG. 2D.

Figure 1A:
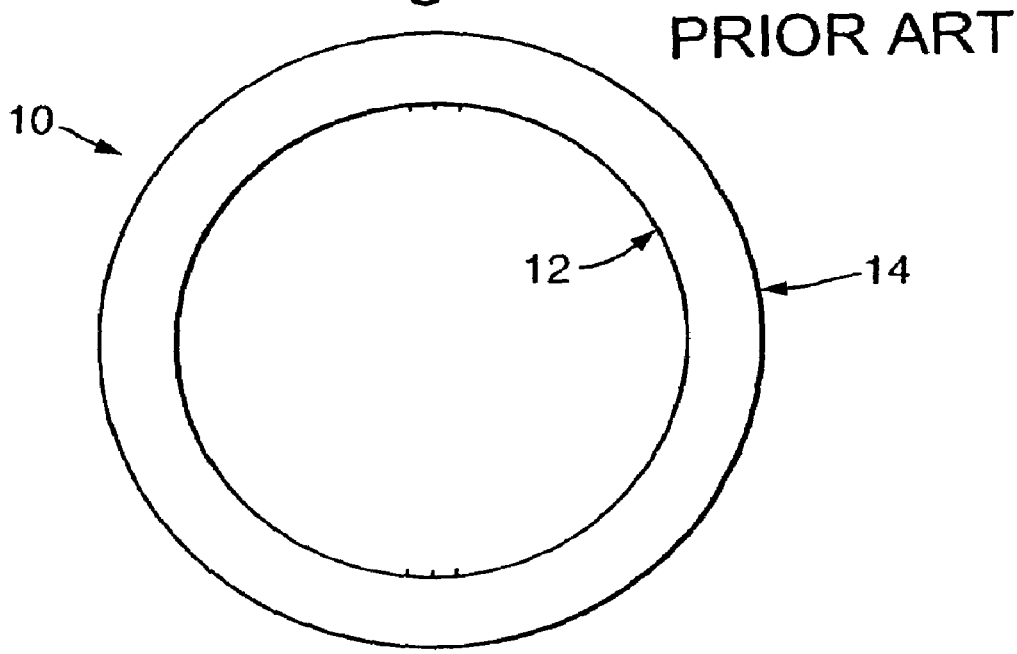
FIGS. 1A to 1D illustrate the prior art process for forming a split casing; and, FIGS. 2A to 2D illustrate a new method of forming a split casing according to one embodiment of the present invention.
Figure 1B:
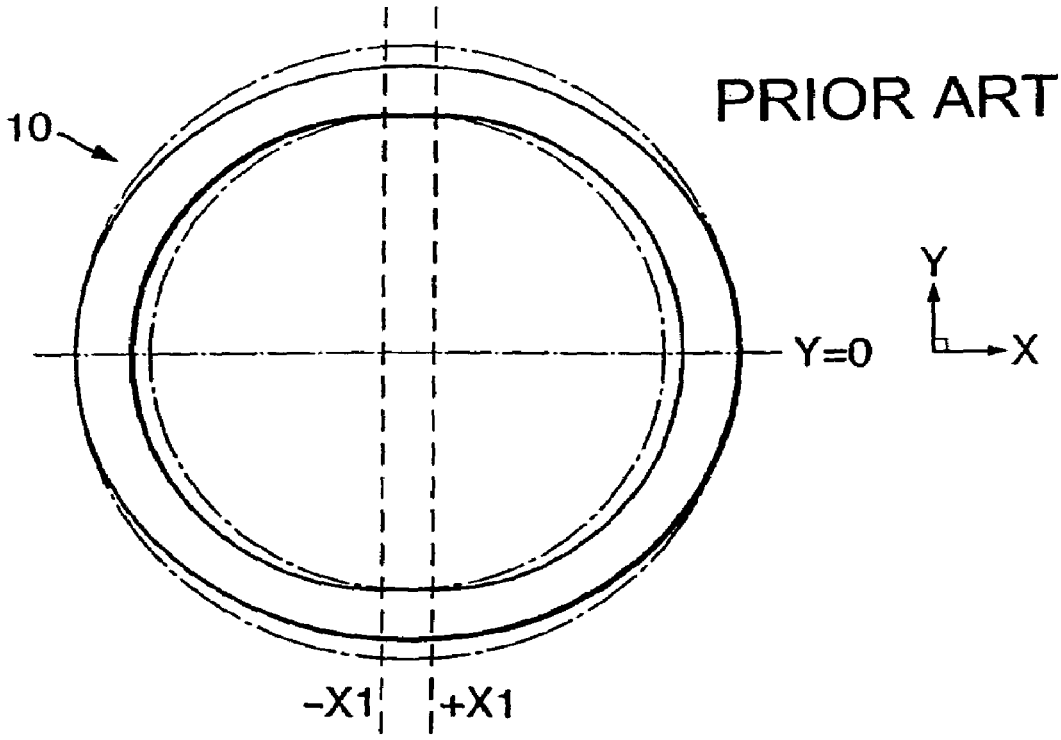
Figure 1C:
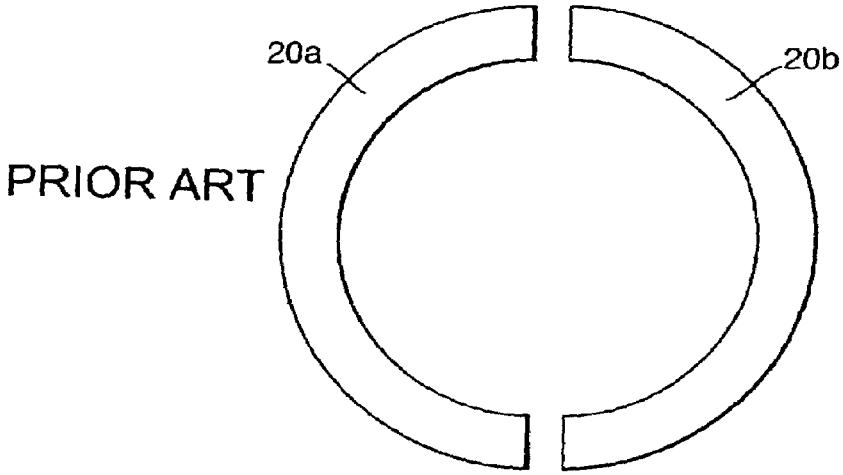
Figure 1D:
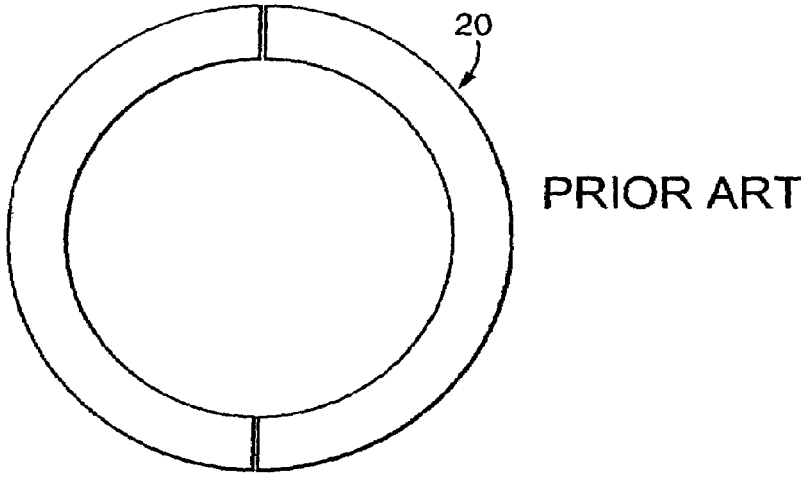

Thus, the deformation of the cylindrical forging reduces or obviates the need to perform off-centre rough machining to ensure that portions of the forging, when split and rejoined, form a substantially cylindrical tubular casing. Consequently, the original forging provided in FIG. 2A will be smaller and cheaper than that provided in FIG. 1A as less material will need to be removed. In addition, there will be substantially less wear on the tools used for rough machining.

Although embodiments of the present invention have been described in the preceding paragraphs with reference to various examples, it should be appreciated that modifications to the examples given can be made without the parting from the scope of the invention as claimed. For example, although the deformation of a forging has been described with relation to a cylindrical forging only, it is possible to apply the principle of the invention to other shapes of forging.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method of manufacturing a split casing of predetermined shape comprising the steps of:

creating a forging;

deforming the forging by compressing it along a first axis and/or extending it along a second axis so that its shape is different from the predetermined shape;

splitting the deformed forging along said first axis;

characterized in that when the deformed forging is split the two resulting casing halves will together form the predetermined shape.

2. A method of manufacturing a forging as claimed in claim 1, wherein the step of creating a forging uses a ring rolling process.

3. A method as claimed in claim 2, wherein the forging created by the ring rolling process is substantially cylindrical in shape.

4. A method as claimed in claim 3, wherein the split casing to be formed in substantially cylindrical in shape.

5. A method as claimed in claim 1, wherein the first and second axes are orthogonal.

6. A deformed forging formed by the method of claim 1.

* * * * *